US006138860A

United States Patent [19]

Comeaux

[11] Patent Number: 6,138,860

[45] **Date of Patent: *Oct. 31, 2000**

[54] PLATE AND GLASS ASSEMBLY

[76] Inventor: Leo C. Comeaux, 1101 W. Jefferson Dr., Lake Charles, La. 70605

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,849

[22] Filed: Aug. 26, 1997

[51] Int. Cl.[7] ..... A47G 19/06; A47G 19/10; B65D 25/36

[52] U.S. Cl. ..... 220/574; 220/23.86; 220/62.13; 220/62.14; 428/34.6; 428/210

[58] Field of Search ..... 220/574, 574.1, 220/575, 23.83, 23.86, 62.14, 62.13, 62.22, 62.15; 206/459.5; 428/34.4, 34.6, 195, 200, 203, 204, 207, 210, 156, 172

[56] References Cited

U.S. PATENT DOCUMENTS

| | | | |
|---|---|---|---|
| D. 211,532 | 6/1968 | Ashton . | |
| 0,425,768 | 4/1890 | Ezell | 220/574 |
| 1,196,803 | 9/1916 | Mulholland | 220/574 |
| 1,688,992 | 10/1928 | Smith . | |
| 1,862,533 | 6/1932 | Fish, Jr. | 220/574 |
| 2,240,020 | 4/1941 | Raiser . | |
| 2,318,149 | 5/1943 | Ferman | 220/23.83 |
| 2,565,912 | 8/1951 | Davis . | |
| 2,920,804 | 1/1960 | Minton . | |
| 3,847,324 | 11/1974 | Uchanski et al. | 220/574 |
| 3,955,672 | 5/1976 | Brundage . | |
| 4,008,347 | 2/1977 | Amberg et al. | 220/62.14 |
| 4,461,396 | 7/1984 | Harper . | |
| 4,595,611 | 6/1986 | Quick et al. | 220/62.13 |
| 4,732,274 | 3/1988 | Bouton . | |
| 5,058,737 | 10/1991 | Patterson et al. | 220/574 |
| 5,060,820 | 10/1991 | Boerner . | |
| 5,240,136 | 8/1993 | Patterson et al. | 220/574 |
| 5,292,028 | 3/1994 | Patterson . | |
| 5,419,454 | 5/1995 | Stowell et al. | 220/574 |
| 5,485,937 | 1/1996 | Tseng | 220/574 |

OTHER PUBLICATIONS

Camco Manufacturing, "Slip–Stop" product brochure.

*Primary Examiner*—Allan N. Shoap
*Assistant Examiner*—Niki M. Eloshway
*Attorney, Agent, or Firm*—N. Stephan Kinsella; Warner J. Delaune

[57] ABSTRACT

A plate and glass assembly in which a single hand may be used to support both the plate and glass. According to one embodiment, a plate has a food-receiving surface and a bottom surface. A layer of non-slip material is adapted to be interposed between the bottom surface and a mouth of a beverage container when the plate is placed atop the mouth.

12 Claims, 4 Drawing Sheets

PLATE AND GLASS ASSEMBLY

BACKGROUND OF THE INVENTION

1. Field of the Invention

The present invention relates to food plates and beverage containers (i.e. glasses) and, in particular, to a plate and glass assembly that enables a user to hold both the plate and glass simultaneously with only one hand.

2. Description of the Related Art

Plates and glasses are often used to serve food and beverages. As used in this application, the term "plate" refers to any standard means for holding food, such as a typical plate or dish having a substantially flat surface and bottom and a rim, and also includes items such as trays, platters, or other devices upon which food may be placed and that are small enough to be held with one hand. Plates may be constructed of any material suitable for holding food, and have a top or food-receiving surface or side and a lower or bottom surface or side. As used in this application, the term "glass" refers to any type of beverage container, typically of cylindrical shape with a circular-shaped mouth, and includes stemmed and non-stemmed standard glasses as well as beverage cans and cups used to hold beverages. Glasses may be constructed of any material suitable for holding a beverage, such as glass, plastic, metal, or china. In the case of a beverage can, for example, the can typically has a cylindrical shape and a circular-shaped rim or mouth at the top end, as well as a drink opening hole just below the mouth.

Food and beverages are consumed by humans in a variety of social settings or functions. For example, in parties or other social functions, food and drink are often served in a buffet setting in which there is little or no access to tables or to a suitable place to rest plates and/or glasses. This causes difficulties, since one hand is needed to hold the plate and the other hand used to eat, making it difficult to also hold the glass. Those foods requiring the use of utensils are particularly difficult to handle. This may cause food to be spilled and/or drink to be spilled.

Additionally, in social or business functions, it is often desirable to engage in customary greetings involving the shaking of hands or the exchange of business cards. Holding a plate and a beverage container while trying to consume the food and also participate in the normal conduct of greeting and exchanging business cards is very awkward.

One placed in this situation may decide to forego the food and simply drink, or alternatively to forego the drink and content oneself with the food. Alternatively, one may consume both the drink and the food but do so sequentially, i.e., finish doing one before starting the other, rather than doing both more or less simultaneously as would be most desirable. Participants in such functions or situations also typically resort to other practices in an effort to cope with the aforementioned problem, such as:

- placing food or drink onto furniture not designed for that purpose (e.g. pianos, mantel, fine furniture, etc.), or even onto the floor, which may require the user bending down and placing the glass on the floor while eating food from the plate;
- holding the plate and drink container with one hand, which may cause one or both to be dropped or food or beverage spilled;
- placing the drink container on the plate; or
- placing the plate on the drink container.

None of these solutions has proved to be entirely satisfactory. Furniture can be easily ruined by the activity described above. Holding a plate and drink with one hand may be possible, but is usually difficult and results in an unstable arrangement, since a glass placed on a plate or a plate placed on a glass is typically unstable. Thus, resorting to these coping tactics can create an uncomfortable feeling for fear of losing control and spilling food and drink, often in a setting where such an accident can be quite embarrassing.

There is thus a widely recognized need for a convenient and inexpensive means for addressing this problem, i.e. for simultaneously holding a plate and a glass while using only one hand, thereby freeing the other hand to carry out such tasks as manipulating a fork or shaking hands in greeting. These problems may be collectively referred to herein, for convenience, as the "buffet problem." Various techniques have been utilized in an attempt to address this problem. A number of these techniques involve mechanically securing the plate to the glass or the glass to the plate.

U.S. Pat. No. 5,060,820, issued Oct. 29, 1991 to Boerner, for example, discloses a plate the bottom surface of which is modified so as to include one or more members capable of extending downward from the bottom of the plate and fitting over or along a beverage container and which may be grasped with the same hand used for grasping the beverage container. However, the protruding members may be aesthetically unpleasing or otherwise undesirable, or difficult to manipulate. Setting down a plate having protruding members may be difficult, for example, since the plate may no longer have a sufficiently flat bottom surface.

Additionally, in the prior art devices in which the glass is held securely to the plate, such as Boerner, there is a possibility of upsetting the plate if the drink container is stuck or otherwise held tightly to the plate. For example, with the system taught in Boerner, it can be difficult to switch from eating to drinking since, when removing the glass from the member on the bottom of the plate, the user must manipulate the fingers of one hand from holding onto the tabs and glass to just holding the glass while grasping the plate with the other hand.

U.S. Pat. No. 5,292,028, issued Mar. 8, 1994 to Patterson, describes a plate assembly having a glass holder formed on the underside thereof, where the plate assembly comprises a plate holder adapted to hold a separate disposable plate. One disadvantage of Patterson's assembly is that a separate plate holder is required in addition to the plate, and the glass holder formed thereunder may not be aesthetically appropriate in some settings. Additionally, the glass holder may make it difficult to set down the assembly when one is done using it.

Patterson also describes various previously-proposed assemblies for eliminating the need to use both hands to carry a plate and a glass. One such assembly is shown in U.S. Pat. No. 2,240,020, issued Apr. 29, 1941 to Raiser. That assembly includes a plate having a central aperture for a cup and a hollow handle which extends downwardly from the cup-receiving receptacle. Although this device permits one to carry both the plate and cup with one hand, one disadvantage of this technique is that liquid can readily slosh over the open top of the cup and onto the food. Additionally, the food on the plate can easily come into contact with and foul the exterior of the drinking cup; and food may slosh through the opening in the plate and pass through the hollow handle onto an underlying table or lap.

U.S. Pat. No. 2,920,804, issued Jan. 12, 1960 to Minton, discloses a somewhat similar assembly in which a hollow sleeve forms a receptacle for a glass. This sleeve is joined to a plate component by a bead which releasably engages a flange on the plate. U.S. Pat. No. D 211,532, issued Jun. 25, 1968 to Ashton, discloses a serving tray having an overall configuration very similar to that of Minton. U.S. Pat. No. 3,955,672, issued May 11, 1976 to Brundage, discloses another plate having a hole in which an open cup is set. In this case, the plate has a channel for balancing the plate on the user's forearm while he grasps the lower end of the cup.

U.S. Pat. No. 4,461,396, issued Jul. 24, 1984 to Harper, discloses a plate having a recess for the lower end of a glass in its upper surface. The user's thumb protrudes upwardly through a hole in the plate and presses against the base of the glass to retain it in the recess. This arrangement shares disadvantages with the devices disclosed in the patents cited above. For example, momentary relief of the thumb pressure may allow the glass to become dislodged; the drink can easily slosh out of the glass and onto the food; the food can slosh through the hole in the plate; and the food contained on the plate can easily get on the outside of the glass.

U.S. Pat. No. 1,688,992, issued Oct. 23, 1928 to Smith, discloses a cup and saucer combination in which the saucer may either support or cover the cup without sliding about, through the use of protruding shoulders formed into the plate. U.S. Pat. No. 2,565,912, issued Aug. 28, 1951 to Davis, discloses a watercolor paint set in which the palette has a center portion that rests in the mouth of a water container, through the use of protruding flanges and ribs formed into the plate. These devices and techniques have similar disadvantages as disclosed above. For example, the protruding flanges or shoulders may be aesthetically unpleasing or otherwise undesirable.

Another disadvantage of some of the above prior art plate-and-glass holder techniques is that it may be relatively expensive to mold separate components, such as glass holders, shoulders, flanges, ribs, and the like, formed into the bottom of a plate or plate holder. Additionally, glasses come in various types having different diameter mouths at their open, upper end. This can lead to the need for different glass holders of different sizes for different plates, diminishing the versatility or usefulness of these prior art approaches. Further, where molds are required for the glass holder portions, different molds must be employed for each different glass mouth size and shape, which can cause further expense.

Additionally, some of these techniques involve relatively complex structures. For example, U.S. Pat. No. 4,732,274, issued Mar. 22, 1988 to Bouton, discloses a portable tray table having a cup holder included integrally in the tray. The cup holder can be grasped by one hand to support the tray. However, the tray structure is very complex and would be expensive to produce. Additionally, using complex structures can require the use of construction materials formed from rigid substances, which may not always be desirable, for example with disposable plates.

Techniques in which the cup holder is in the middle of a tray robs the tray of some of the prime space which could have been utilized for the holding of food. Placing glasses on top of plates is similarly disadvantageous since space that could be used for food is taken up by the glass. Additionally, the food may come into contact with the glass, as mentioned above, and such arrangements may be unstable. Techniques in which plates have drink holders attached to the side of the plate create torque and make it more difficult to hold the plate with the drink at the end of a lever arm.

Accordingly, previous techniques designed to address the aforementioned buffet problem are accompanied by various disadvantages. There is, therefore, a need for a convenient and inexpensive way of simultaneously holding both a food plate and a glass using only one hand that overcomes the disadvantages and drawbacks of the prior art.

SUMMARY

A plate and glass assembly in which a single hand may be used to support both the plate and glass. According to one embodiment, a plate has a food-receiving surface and a bottom surface. A layer of non-slip material is adapted to be interposed between the bottom surface and a mouth of a beverage container when the plate is placed atop the mouth.

BRIEF DESCRIPTION OF THE DRAWINGS

These and other features, aspects, and advantages of the present invention will become more fully apparent from the following description, appended claims, and accompanying drawings in which:

DESCRIPTION OF THE PREFERRED EMBODIMENT

The present invention provides a convenient, aesthetically acceptable, and inexpensively manufacturable means of holding a plate and glass with one hand. The present invention also provides an aesthetically useful interface between the underside of the plate and the top of the glass. In the present invention, a plate is set atop a glass, and the user holds the glass with one hand, thereby also supporting the plate. This frees up the user's other hand for eating food from the plate, shaking hands, and the like. Interposed between the mouth of the glass and the bottom surface of the plate is a layer of non-slip or slip-resisting material, which greatly increases the stability of the arrangement.

Normally, without the interposed non-slip layer of the present invention, a plate (such as a standard glass buffet-style plate) placed atop a typical beverage container formed of glass would be prone to sliding around the mouth of the glass in unstable fashion, if the user holds only the glass with one hand. At a tilt angle of approximately 12°, a plate will slide off of the top of the glass. However, in the present invention a layer of suitable non-slip material is situated between the plate and glass so that the angle at which the plate slides from the glass is increased, for example to an angle of approximately 67° or greater, in some embodiments. This results in a stable arrangement in which the plate is situated atop an ordinary drink container or glass, thereby allowing the user to hold the arrangement by grasping solely the glass with just one hand.

Figure 1:
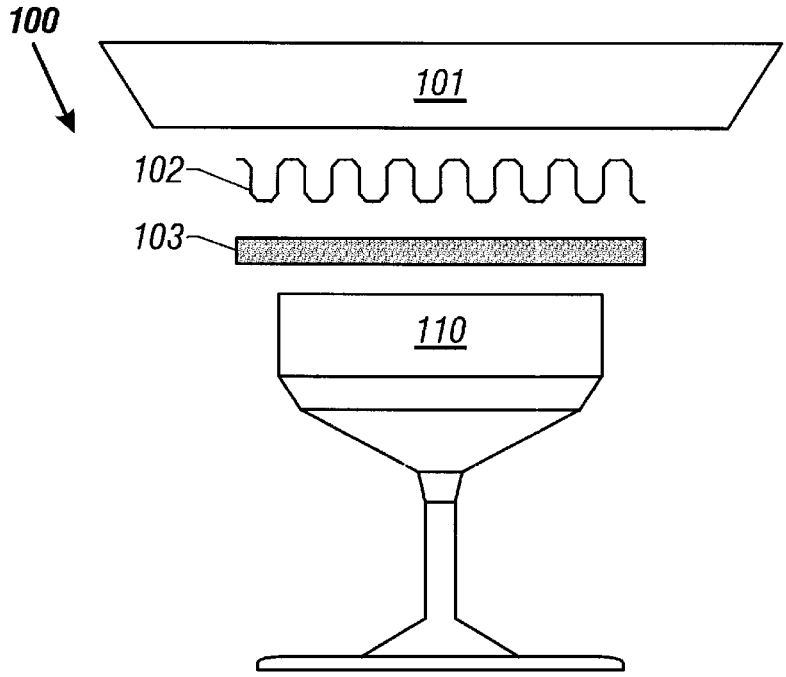
FIG. 1 is a cross-sectional view of a plate and glass assembly having a layer of bonding material and a layer of non-slip material, in accordance with an embodiment of the present invention.

Referring now to FIG. 1, there is shown a cross-sectional view of a plate and glass assembly 100 having a layer of bonding material 102 and a layer of non-slip material 103, in accordance with one embodiment of the present invention. Assembly 100 comprises plate 101 and glass 110, where plate 101 is set atop the mouth of glass 110. In the embodiment illustrated in assembly 100, non-slip layer 103 is preferably disc shaped, preferably having a diameter smaller than that of the flat, bottom portion of plate 101 but larger than that of the average or typical glass mouth, such as the mouth of glass 110, and is affixed to the bottom of plate 101 with bonding material 102. Thus, when plate 101, having non-slip layer 103 on its bottom surface, is placed atop the mouth of glass 110, plate 101 will not slide around or off of the top of the glass if the glass is held by one hand and is maintained in a normal upright or near-upright position in the manner in which a glass would normally be held so as to avoid spilling the beverage contained therein.

As will be appreciated, bonding material 102 is any material that provides a permanent or temporary bond between the bottom surface of plate 101 and non-slip material layer 103. Bonding material 102 is preferably a tacky adhesive such as a ELMER'S spray adhesive. The layer of bonding material 102 thus provides a means for affixing the non-slip layer to the bottom of plate 101. In alternative embodiments, non-slip layer 103 may be attached to the bottom surface of plate 101 by other suitable techniques, including techniques using adhesives, magnetism, suction cups having a vacuum effect, electrostatic techniques, hook-and-loop fasteners (e.g. VELCRO™ fasteners), and the like.

The non-slip layer 103, which may also be referred to as a slip-resisting or non-skid material, is a material having a slip resistance greater than that naturally provided by the underside of a typical plate versus the mouth of the glass (also referred to as a lip or rim of the glass). In one embodiment, non-slip layer 103 is composed of a disk of material composed of a non-adhesive, multipurpose shelf liner such as RUBBERMAID, INC.'S GRIP LINER™ or MANCO, INC.'S EASY LINER™ shelf-liners, both of which are a rubberized lacy material with a "waffle" or other irregular texture and having an approximate thickness of 1.5 mm. In alternative preferred embodiments, non-slip layer 103 is composed of: soft rubber having at least one side with a slightly roughened or waffle texture; a disk consisting of soft paper; a disk of soft foam rubber; a disk "sandwich" having a soft-resilient material such as paper covered with a thin plastic film, as described in further detail below with respect to sandwich-type non-skid disk 800 of FIG. 8; or similar materials have sufficient slip-resistant properties.

In empirical testing, using a 7" diameter clear glass buffet-style plate and a glass having a height of 3.63" with a 3.25" diameter mouth, without using the non-slip layer the average tilt angle when the plate slipped from the glass was 13.93° (the angle is the angle of the flat bottom surface of the plate measured from horizontal). However, using a non-slip layer interposed between the plate and glass, as, for example, in the embodiment illustrated in FIG. 1., empirical testing showed a tilt of over 47° or greater can be attained before the plate slips from the glass. As will be understood, this is useful since food items will often slide off or begin to slide off of a plate before 45° is reached, for example roughly between 20° and 40° from horizontal, depending on the type of food item, plate shape and surface, speed of tilt, etc. Also, a glass even half full of liquid will begin to spill at 45°. Accordingly, the present invention, which allows the plate and glass to be tilted at up to 45° when the combination is held by the glass, will provide a significant improvement in the handling of a plate and a glass in a buffet or other setting, while overcoming the aesthetic, operational, and other disadvantages of previous techniques for overcoming this problem.

Figure 2:
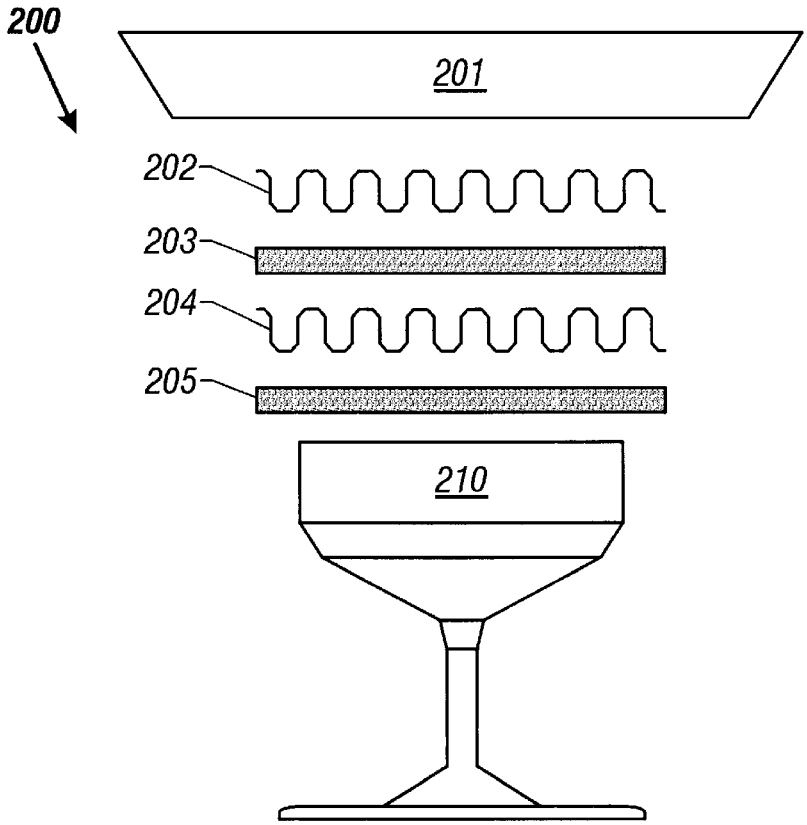
FIG. 2 is a cross-sectional view of a plate and glass assembly also having a printed or decorative layer, in accordance with another embodiment of the present invention.

Referring now to FIG. 2, there is shown a cross-sectional view of a plate and glass assembly 200 having a printed or decorative layer 203, in accordance with another embodiment of the present invention. Assembly 200 comprises plate 201 and glass 210, and also comprises bonding material layer 202, printed or decorative layer 203, bonding material layer 204, and non-slip layer 205. In assembly 200, bonding material layer 202 is used to affix decorative layer 203 to the bottom of plate 201. Plate 201 is preferably a clear or transparent plate which allows decorative layer 203 to be seen through the bottom of plate 201 while looking down from the top. A second bonding layer 204 affixes the slip resisting material 205 to the decorative layer 203.

As will be appreciated, decorative layer 203 can serve any number of aesthetically or commercially useful functions. For example, decorative layer 203 can include an ornamental decoration or a printed message or other type of design. This layer can be formed, for example, from paper printed with messages or designs, or cut or shaped into desirable designs. This allows the use of the non-slip properties of the present invention to incorporate the decorative layer 203, which serves the purpose of improving the aesthetics of the plate and/or providing a means of presenting a message. For example, for ornamental, decorative, or aesthetic purposes, decorative layer 203 may comprise lace, doily, or other similar items designed to enhance the appeal of plate 201. Alternatively, a message such as a logo, slogan, bride and groom names, advertisement, written message, and the like, or pictorial representation for special occasions (e.g., bride and groom silhouettes) can be incorporated into layer 203.

Figure 3:
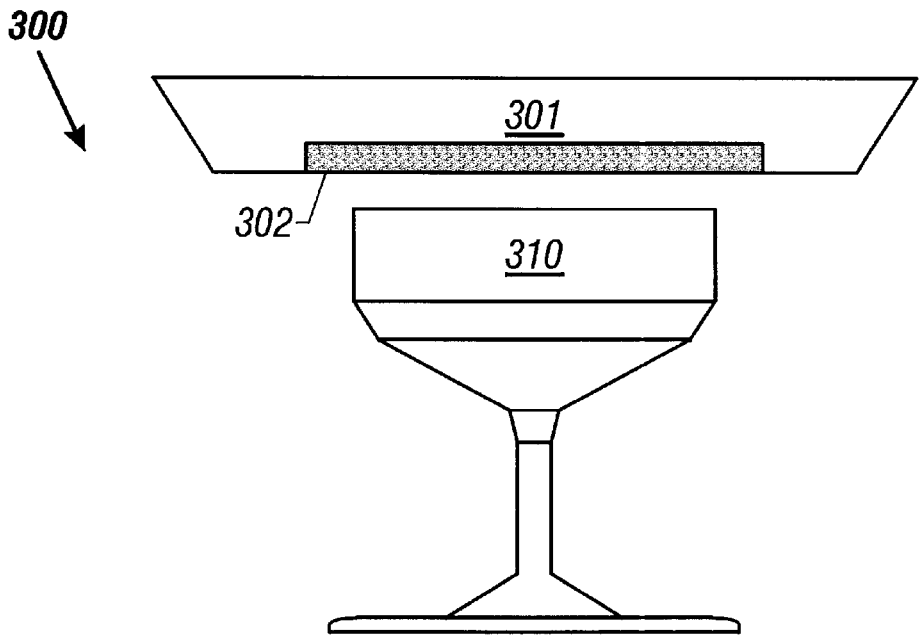
FIG. 3 is a cross-sectional view of a plate and glass assembly in which the non-slip layer is integrated into the plate, in accordance with another embodiment of the present invention.

Referring now to FIG. 3, there is shown is a cross-sectional view of a plate and glass assembly 300 in which non-slip layer 302 is integrated into plate 301, in accordance with another embodiment of the present invention. Assembly 300 also comprises glass 310. As will be appreciated, non-slip layer 302 may be incorporated into the base of plate 301 during manufacturing, where plate 301 comprises a cavity sufficient to contain non-slip layer 302. In an alternative embodiment, a non-slip layer is integrated into a plate during manufacturing, without the plate having a cavity to contain the non-slip layer. For example, a non-slip layer may be affixed permanently or temporarily to the bottom of a plate that does not have a cavity, during manufacturing.

Figure 4:
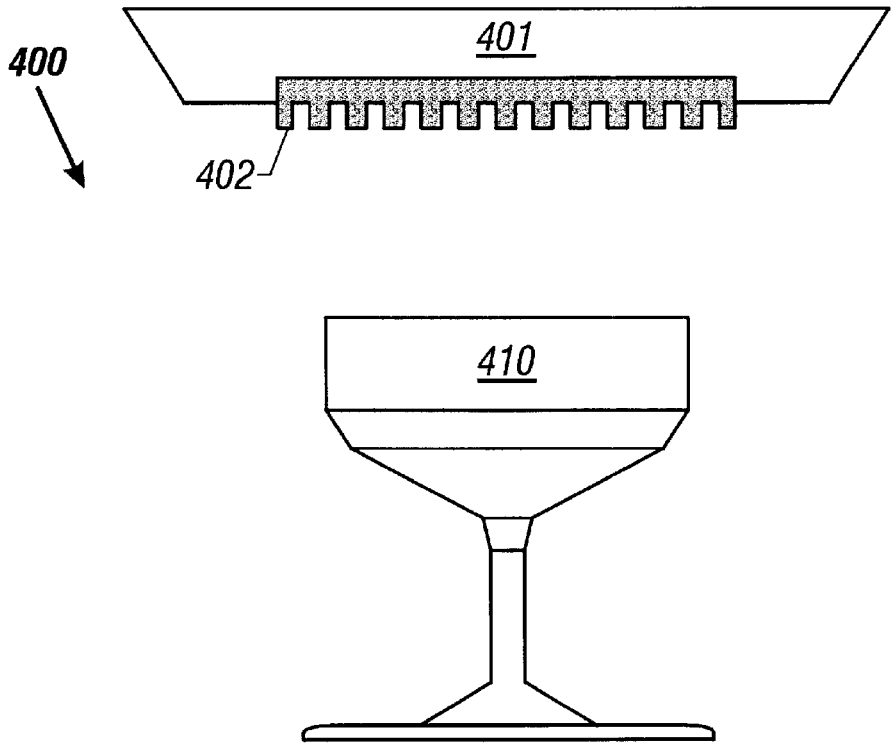
FIG. 4 is a cross-sectional view of a plate and glass assembly in which a non-slip bottom surface is integral with the plate, in accordance with another embodiment of the present invention.

Referring now to FIG. 4, there is shown is a cross-sectional view of a plate and glass assembly 400 in which non-slip surface 402 is integral with plate 401, in accordance with another embodiment of the present invention. Assembly 400 also comprises glass 410. As will be appreciated, the bottom surface 402 of plate 401 is a surface having non-slip properties similar to those of the non-slip layers of the embodiments illustrated in FIGS. 1–3. In one embodiment, non-slip bottom surface 402 is an irregular surface which serves to provide skid resistance to a glass upon which plate 401 is placed. For example, non-slip bottom surface 402 consists of grit, lumps, nodules, bristles or like protrusion to create an irregular surface having non-slip or slip-resisting properties.

Figure 5:
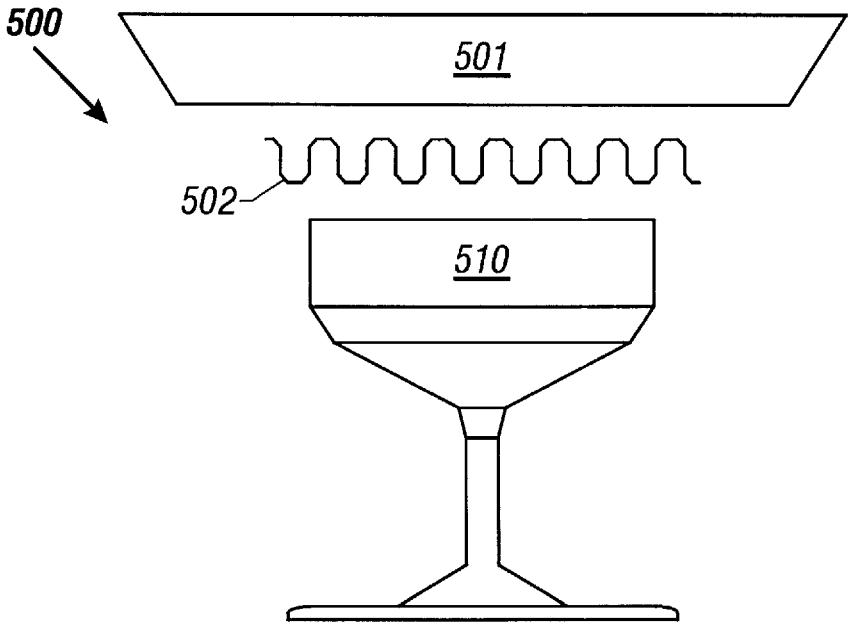
FIG. 5 is a cross-sectional view of a plate and glass assembly having a layer of bonding material with non-slip properties, in accordance with another embodiment of the present invention.

Referring now to FIG. 5, there is shown a cross-sectional view of a plate and glass assembly 500 having a layer of bonding material 502 with non-slip properties, in accordance with another embodiment of the present invention. Rather than attaching a non-slip layer 103 to a plate 101 via a bonding material layer 102, as described above with respect to FIG. 1, a bonding type material may be used which inherently contains sufficient slip-resisting characteristics. In one embodiment, bonding material layer 502 consists of PLASTI-DIP™ HEAVY DUTY FLEXIBLE RUBBER COATING material (as described in U.S. Pat. No. 4,536,454), and may be applied to the bottom surface of plate 501 in liquid or semi-liquid form in a relatively smooth and uniform layer that is roughly disc shaped, and allowed to cure. This eliminates the need for separate bonding material and non-slip layers, as in some embodiments disclosed herein.

In alternative embodiments, it will be appreciated that the non-slip layer, when affixed to the bottom surface of a plate, need not be in a single continuous piece or have a disc shape. For example, a donut-shaped ring or a decorative fleur-de-lis may used instead. Alternatively, small radial pads like spokes of a wheel may be applied to the bottom surface of the plate, sufficient to ensure that, when the plate is placed atop a glass mouth, the plate will rest on top of the glass at several points (for example, at least three points, roughly equally spaced around the diameter of the mouth of the glass) with non-slip material interposed therebetween at those points. In another alternative embodiment, the layer of non-slip material may be composed of a plurality of separate portions, such as a plurality of small circular disks affixed to the bottom surface of the plate sufficient to contact the mouth of a glass at enough locations around the mouth's circumference so that the non-slip advantages explained herein are achieved.

Alternatively, instead of affixing the non-slip material to the bottom of the plate, the non-slip material may be affixed to the top or mouth of the glass, thereby ensuring that non-slip material will be interposed between the plate's bottom surface and the glass when the plate is place atop the glass. For example, a layer of non-slip material may line all or portions of the mouth or rim of the glass.

Figure 6:
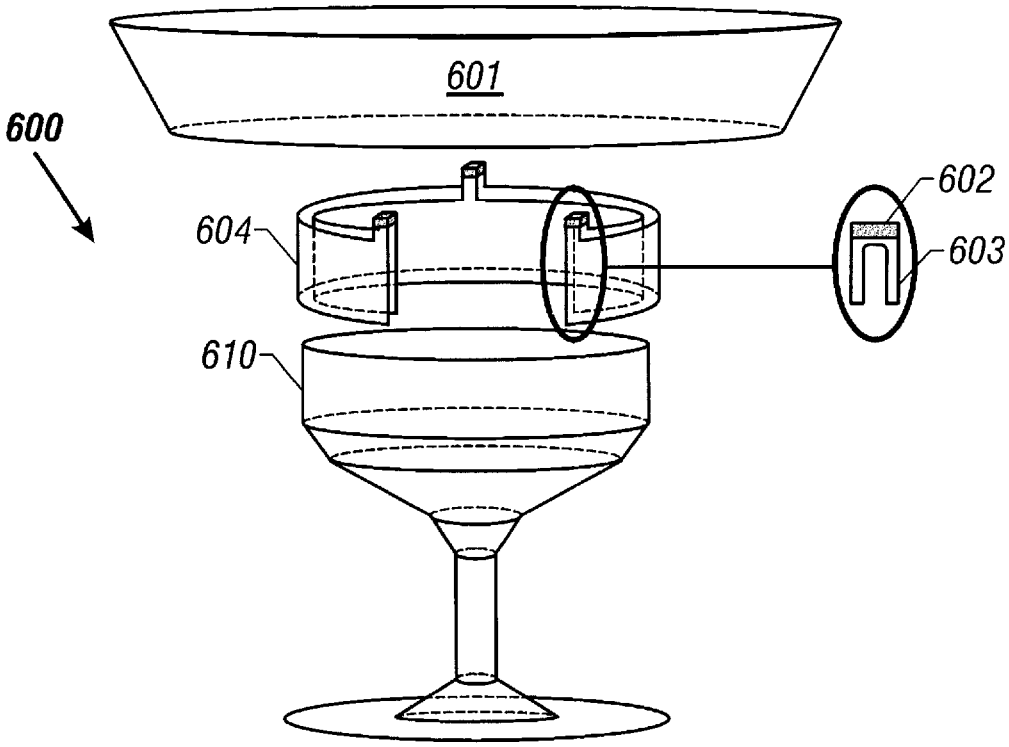
FIG. 6 is a perspective view of a plate and glass assembly having a glass mouth clip for interposing non-slip material between the plate and glass, in accordance with another embodiment of the present invention.

Referring now to FIG. 6, for example, there is shown a perspective view of a plate and glass assembly 600 having a glass mouth clip 604 for interposing non-slip material portions such as portion 602 between the plate 601 and glass 610, in accordance with another embodiment of the present invention. In this embodiment, clip 604 has a clamp portion by which it may be slipped onto the open mouth or rim of glass 610 and thus fixedly attached thereto. Clip 604 comprises at least three projections such as projection 603, extending upward therefrom, each projection having a non-slip material portion such as non-slip material portion 602 affixed to the top thereof. In use, plate 601 rests atop glass 601 with the slip-resisting material providing the interface to prevent slippage. As will be appreciated, the plurality of non-slip material portions can be considered to collectively comprise a non-slip layer.

Clip 604 is preferably designed so as to avoid or minimize conflict with the consumption of the beverage from glass 610. For example, clip 604 may not clamp onto the entire circumference of the mouth of glass 610, thereby leaving a clear rim portion for drinking. Additionally, by providing projections such as projection 603 with the slip-resistant material, the portions of clip 604 along its circumference between projections may be used for drinking. Otherwise, a continuous coating of slip-resistant material around the circumference of clip 604, without the use of projections, may make drinking of liquid from glass 610 unpleasant. In an alternative embodiment, a plurality of projections such as projection 603 may be clipped independently onto the rim or mouth of glass 610 without the use of clip 604.

Figure 7:
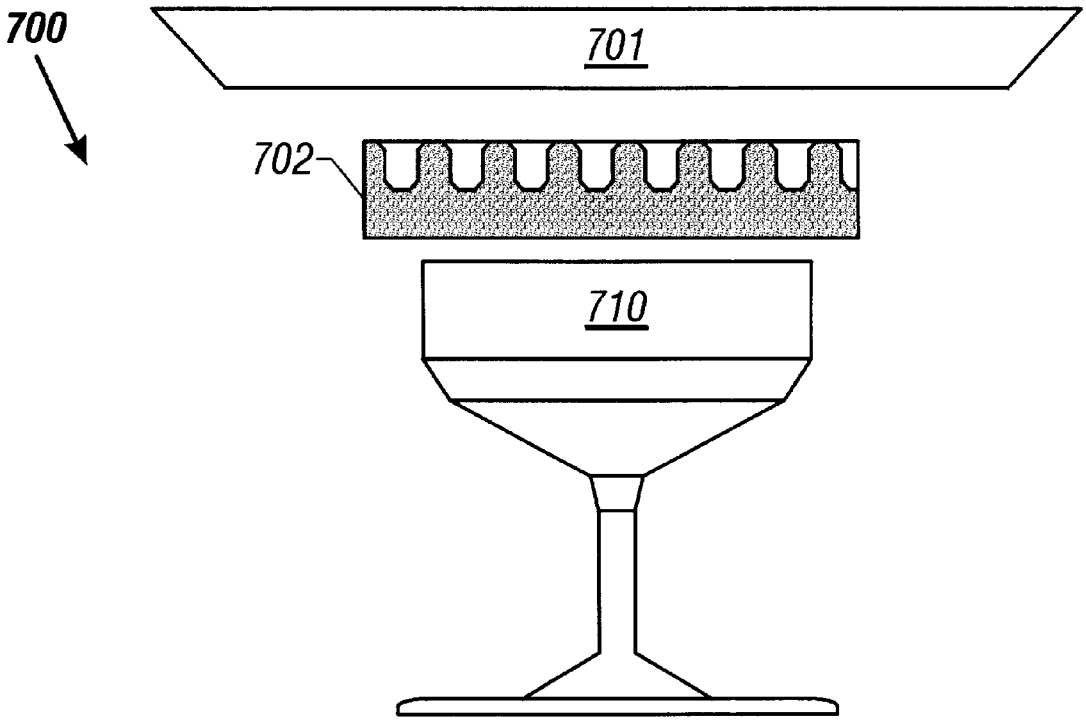
FIG. 7 is a cross-sectional view of a plate and glass assembly having a single layer of material with bonding and non-slip properties and suitable for receiving printing inks of various colors, in accordance with another embodiment of the present invention.

Referring now to FIG. 7, there is shown a cross-sectional view of a plate and glass assembly 700 having plate 701, glass 710, and a single layer of material 702 with bonding and non-slip properties and suitable for receiving printing inks of various colors, in accordance with another embodiment of the present invention. In one embodiment, material layer 702 is commercially-available "clear static vinyl" which may be imprinted with an informative or decorative design. Material layer 702 may be affixed to the bottom surface of plate 701 through adhesive or by the use of the static adherence properties of clear static vinyl, as will be appreciated.

Figure 8:
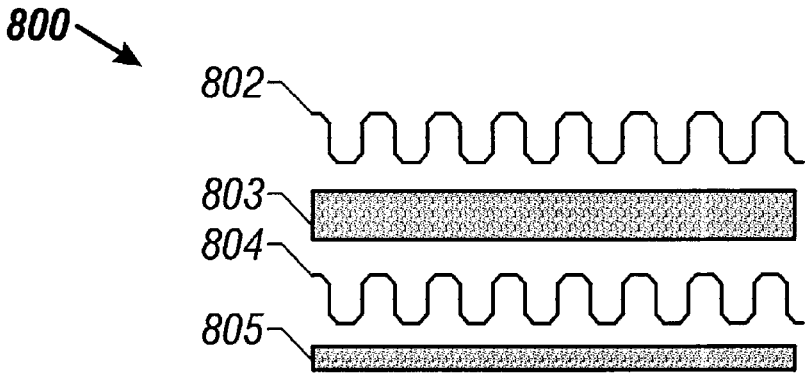
FIG. 8 is a cross-sectional view of a sandwich-type non-skid disk having a soft, resilient layer of material coated on one side with bonding adhesive and bonded at its other side to a thin plastic film.

Referring now to FIG. 8, there is shown a cross-sectional view of a sandwich-type non-skid disk 800 having a soft, resilient layer 803 of material coated on one side with bonding adhesive 802, and bonded at its other side with bonding material 804 to a thin plastic film layer 805. As will be appreciated, disk 800 may be used as a non-skid interface in assemblies such as those shown in FIGS. 1 and 2, where bonding adhesive 802 is used to bond disk 800 to the bottom of a plate, and the combined effect of layer 803 and layer 805 provides non-skid properties and layer 805 contacts the rim of a glass when the plate and disk are placed atop the glass. Resilient layer 803 may be formed from a layer of relatively soft foam, or of soft paper such as the type typically used in disposable drink coasters, or other sufficiently structural material, in some embodiments. Thin plastic film layer 805 may be formed from clear static vinyl, or from products such as SARAN WRAP™, HANDY WRAP™, or GLAD CLING WRAP™ wrapping material; polyethylene, or other types of plastic film. As will also be appreciated, non-skid disk may also, in an alternative embodiment, incorporate a decorative layer.

The present invention, therefore, addreses the aforementioned buffet problem, while overcoming the disadvantages of other techniques designed to address this problem, as described above. In the present invention, for example, no change of finger positions on or grasp of a glass is required when a sip of beverage is desired. The free hand is simply used to grasp the plate, while the hand already holding the glass can be used for drinking from the glass, thereby avoiding the disadvantages with switching from eating to drinking in some prior art devices, as explained above. Also unlike prior art techniques, the aesthetics of the plate can be enhanced, not diminished, by using the decorative layer of the present invention. The decorative layer may also be usefully employed for commercial display of logos, advertisements, messages, and the like. Additionally, the non-slip aspect of the present invention may be incorporated onto plates or glasses at relatively low cost.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. An apparatus for use with a beverage container having a mouth at its top, comprising:

(a) a plate with a food-receiving surface and a bottom surface;

(b) a layer of bonding material;

(c) a decorative layer affixed to the bottom surface by the layer of bonding material, wherein the plate and the layer of bonding material are sufficiently transparent so as to permit the decorative layer to be seen through the plate;

(d) a layer of non-adhesive non-slip material; and (e) a second layer of bonding material between the decorative layer and the layer of non-slip material for affixing the layer of non-slip material to the decorative layer and hence to the bottom surface, wherein:

the plate can be placed atop the beverage container so that the layer of non-slip material is interposed between the bottom surface and the mouth to increase a tilt angle at which the plate will slide from the beverage container;

the plate can be placed atop the beverage container to increase said tilt angle without a use of physical force which would be required to insert a beverage container into a mechanical holder;

the plate can be lifted from the beverage container without any resistance other than the weight of the plate and bonding and non-slip layers due to the non-adhesiveness of the non-slip layer and due to the lack of use of a mechanical holder which would physically attach the plate to the beverage container; and the layer of non-slip material does not interfere with setting the plate down on a surface as would a mechanical holder attached to the bottom surface of the plate.

2. The apparatus of claim 1, wherein the layer of non-slip material is substantially disk-shaped with a diameter less than that of the bottom surface and greater than that of the mouth.

3. The apparatus of claim 1, wherein the layer of non-slip material comprises a plurality of separate portions of non-slip material.

4. The apparatus of claim 1, wherein the layer of non-slip material comprises one of a layer of soft rubber, a layer of thin plastic film, a layer of soft paper, a layer of soft foam rubber, a layer of clear static vinyl, a layer of rubberized material, a layer of rubberized material having an irregular texture and an approximate thickness of 1.5 mm, and a combination of a soft resilient material covered with a layer of thin plastic film.

5. The apparatus of claim 1, wherein the decorative layer comprises one of a paper layer printed with a design and a paper layer cut or shaped into a design.

6. The apparatus of claim 1, wherein the layer of bonding material comprises a tacky adhesive so that the layer of non-slip material is easily removable from the bottom surface.

7. A non-skid disk for coupling to a bottom surface of a plate, the disk comprising:

(a) a decorative layer having a top side and a bottom side;

(b) a first layer of bonding material applied at a bottom side thereof to the top side of the decorative layer, wherein the first layer of bonding material is not adhesively secured to a film liner layer at a top side of the first layer of bonding material so that the first layer of bonding material may be used to affix the decorative layer to the bottom surface of the plate, wherein the plate and the first layer of bonding material are sufficiently transparent so as to permit the decorative layer to be seen through the plate;

(c) a resilient layer having a top side and a bottom side;

(d) a second layer of bonding material between the decorative layer and the resilient layer for affixing the top side of the resilient layer to the bottom side of the decorative layer; and (e) a layer of thin plastic film affixed to the bottom side of the resilient layer, wherein the layer of thin plastic film and the resilient layer combine to form a layer of non-adhesive, non-slip material affixed to the decorative layer, wherein the disk can be attached to the bottom surface of the plate via the first layer of bonding material to form an apparatus having a non-slip bottom surface for use with a beverage container having a mouth at its top, wherein, when the disk is attached to the bottom surface of the plate:

the plate can be placed atop the beverage container so that the layer of non-slip material is interposed between the bottom surface and the mouth to increase a tilt angle at which the plate will slide from the beverage container;

the plate can be placed atop the beverage container to increase said tilt angle without a use of physical force which would be required to insert a beverage container into a mechanical holder;

the plate can be lifted from the beverage container without any resistance other than the weight of the plate and bonding and non-slip layers due to the non-adhesiveness of the non-slip layer and due to the lack of use of a mechanical holder which would physically attach the plate to the beverage container; and the layer of non-slip material does not interfere with setting the plate down on a surface as would a mechanical holder attached to the bottom surface of the plate.

8. The non-skid disk of claim 7, further comprising a third layer of bonding material between the resilient layer and the layer of thin plastic film for affixing the layer of thin plastic film to the bottom side of the resilient layer.

9. The non-skid disk of claim 7, wherein the decorative layer comprises one of a paper layer printed with a design and a paper layer cut or shaped into a design.

10. The non-skid disk of claim 7, wherein the non-skid disk has a diameter less than that of the bottom surface and greater than that of the mouth.

11. The non-skid disk of claim 7, wherein the first layer of bonding material comprises a tacky adhesive so that the non-skid disk is easily removable from the bottom surface of the plate.

12. The non-skid disk of claim 7, wherein the resilient layer comprises one of a layer of soft foam and a layer of soft paper such as the type typically used in disposable drink coasters.

* * * * *